US006961964B2

(12) United States Patent
Blenkarn

(10) Patent No.: US 6,961,964 B2
(45) Date of Patent: Nov. 8, 2005

(54) PRE-CURVED WADER WITH FRONT AND BACK SEAMS

(76) Inventor: Michael D. Blenkarn, 1864 Beaulynn Place, North Vancouver, British Columbia (CA) V7J 2T1

( * ) Notice: Subject to any disclaimer, the term of this patent is extended or adjusted under 35 U.S.C. 154(b) by 0 days.

(21) Appl. No.: 10/738,386

(22) Filed: Dec. 17, 2003

(65) Prior Publication Data

US 2005/0132464 A1 Jun. 23, 2005

(51) Int. Cl.[7] ..... A41D 13/00
(52) U.S. Cl. ..... 2/228; 2/82
(58) Field of Search ..... 2/82, 69, 81, 69.5, 2/79, 80, 114, 227; 441/118, 108, 102, 106, 441/111–119, 92–94, 96, 99, 88

(56) References Cited

U.S. PATENT DOCUMENTS

| | | | | | |
|---|---|---|---|---|---|
| 3,090,047 | A | * | 5/1963 | De Grazia | 112/425 |
| 3,329,966 | A | * | 7/1967 | Slavick | 2/2.15 |
| 3,763,498 | A | * | 10/1973 | Rector | 2/2.15 |
| 4,044,478 | A | | 8/1977 | Girard | |
| 4,117,552 | A | * | 10/1978 | Simpson | 2/2.14 |
| 4,117,609 | A | | 10/1978 | Helt | |
| 4,194,308 | A | | 3/1980 | Karlsson | |
| 4,274,159 | A | | 6/1981 | Schmidt | |
| 4,483,019 | A | * | 11/1984 | Spangrud et al. | 2/2.16 |
| 4,533,072 | A | | 8/1985 | Craig | |
| D285,140 | S | | 8/1986 | Ellenberger | |
| 4,858,342 | A | | 8/1989 | Nicholson | |
| 4,912,860 | A | | 4/1990 | Keller | |
| 4,984,377 | A | | 1/1991 | Schneide | |
| 5,022,096 | A | | 6/1991 | Pacanowsky | |
| 5,067,260 | A | | 11/1991 | Jenkins | |
| 5,081,718 | A | * | 1/1992 | Carman et al. | 2/227 |
| 5,210,879 | A | | 5/1993 | Miller | |
| RE34,662 | E | | 7/1994 | Keller | |
| 5,693,412 | A | | 12/1997 | Walters | |
| 5,711,031 | A | | 1/1998 | Clement | |
| 5,832,632 | A | | 11/1998 | Bergeron | |
| 5,867,828 | A | | 2/1999 | Shih | |
| 5,896,676 | A | | 4/1999 | Barousse | |
| 5,901,374 | A | | 5/1999 | Foster | |
| 5,966,842 | A | | 10/1999 | Hart, Jr. | |
| 6,094,745 | A | | 8/2000 | Fulton | |
| 6,154,884 | A | | 12/2000 | Dehner | |
| 6,167,571 | B1 | | 1/2001 | Cheng | |
| 6,280,807 | B1 | | 8/2001 | Shih | |
| 6,317,893 | B1 | | 11/2001 | Walton | |
| 6,357,050 | B2 | | 3/2002 | Thompson | |
| 6,363,531 | B1 | | 4/2002 | Quinn | |
| 6,389,598 | B1 | | 5/2002 | Westers | |
| D461,624 | S | | 8/2002 | Foster | |
| 6,438,757 | B1 | | 8/2002 | Quinn | |
| 6,484,320 | B1 | | 11/2002 | Grady | |
| 2001/0025383 | A1 | | 10/2001 | Thompson | |
| 2002/0116742 | A1 | | 8/2002 | Quinn | |

(Continued)

*Primary Examiner*—Gloria M. Hale
(74) *Attorney, Agent, or Firm*—Antoinette M. Tease

(57) ABSTRACT

A wader that is shaped to allow for ease of movement in the hip and knee areas and that has seams running vertically on the anterior and posterior sides of the leg portions. The wader is designed to alleviate discomfort caused by stiff seams and to address the problem of seam abrasion. The wader is made of breathable fabric, and the seams are sewn and sealed. The wader can include, optionally, a foot-covering device and a cinching device. In the preferred embodiment, the seams are sealed with a thermoplastic adhesive tape. A method of manufacturing the wader described above.

8 Claims, 2 Drawing Sheets

U.S. PATENT DOCUMENTS * cited by examiner

2002/0178484 A1 12/2002 Rausch
2003/0027472 A1 2/2003 Hyun

PRE-CURVED WADER WITH FRONT AND BACK SEAMS

CROSS-REFERENCE TO RELATED APPLICATION

This application is an original nonprovisional application. It does not claim priority back to any previously filed patent application.

BACKGROUND OF THE INVENTION

1. Field of the Invention

The present invention relates generally to waders and more particularly to a breathable wader that is shaped to allow for ease of movement in the knee and hip areas and that has seams running vertically on the anterior and posterior sides of the leg portions. The present invention also covers a method of manufacturing the pre-curved wader with front and back seams.

2. Description of the Related Art

Waders are an item of waterproof clothing that is typically worn by individuals while fishing, duck hunting, conducting repairs, or performing other activities in water. Most waders are constructed with a seam on the inside of the leg, or an inseam, and/or a seam on the outside of the leg. That type of seam placement is typical in the design of a pair of pants. The types of fabrics that are used for waders are generally rather stiff; therefore, when two pieces of wader fabric are stitched together and sealed, the result is a very stiff seam. With the traditional seam placement, every time the wearer flexes his knee, as in walking, the inseam and outside seam tend to fold at the knee. This folding can cause the seams to abrade and wear out over time, especially when the inside knees rub against each other. The seam abrasion can be a problem not only in the knee area, but throughout the entire inseam.

There are a number of patents and published patent applications involving waders, but none that addresses the problem of seam abrasion. U.S. Pat. No. 6,438,757 (Quinn, 2002), U.S. Pat. No. 6,363,531 (Quinn, 2002) and U.S. Publication No. 2002/0116742 (Quinn, 2002) provide a waterproof relief outlet in a breathable wader. U.S. Pat. No. 6,389,598 (Westers et al., 2002) discloses a sealably accessible wader system that allows the wearer to urinate without having to remove the wader or draw the wader down. U.S. Pat. No. 6,357,050 (Thompson, 2002) and U.S. Publication No. 2001/0025383 (Thompson, 2001) relate to an apparatus for facilitating the application and removal of waders and wader boots. More particularly, the invention provides a liner that makes it easier to put waders on and take them off and that is intended to prevent the wearer from drowning if the waders become flooded.

U.S. Pat. No. 6,317,893 (Walton, 2001) covers an improved liner system for uninsulated waders. U.S. Pat. No. 6,280,807 (Shih, 2001) discloses an edge joint structure for connecting a waterproof thermal insulation panel with a breathable fabric panel. U.S. Pat. No. 6,167,571 (Cheng, 2001) provides a wader comprising two leg portions and a hip-waist portion, wherein the leg portions are made of a foam material and the hip-waist portion is made of a breathable material. U.S. Pat. No. 6,154,884 (Dehner, 2000) discloses a wader with interconnected upper and lower sections, wherein the lower section is made of a non-breathable, substantially water-impervious synthetic resin material, and the upper section is made of a breathable synthetic resin material.

U.S. Pat. No. 5,901,374 (Foster, 1999) relates to a flexible knee wader that uses a panel of stretch material such as spandex, rubber or rubber compounds, or synthetic rubber, such as neoprene or neoprene sponge, in the knee area to allow the knee to bend freely. The panel of stretch material used at the knee portion of the garment fills an opening formed in the rigid woven fabric material from which the rest of the garment is made. The panel of stretch material is sewn in place and covered with a waterproof tape. One of the objects of this invention was to eliminate the additional inseam material, greater than the user's actual inseam measurement, that is usually required to allow the leg to move upward when the knee is bent during walking.

U.S. Pat. No. 5,867,828 (Shih 1999) discloses a four-layer wader. The four layers include a gas-permeable layer, a waterproof film layer, an outer cover, and a lining. U.S. Pat. No. 5,210,879 (Miller, 1993) is another invention directed toward facilitating urination during fishing. It provides a closeable, integrally formed extendable tubular member at the crotch. U.S. Pat. No. 5,022,096 (Pacanowsky, 1991) relates to a multicomponent, waterproof, breathable wader. The wader comprises waterproof, breathable, non-elastic, non-stretch right and left panels, each of which has a shape of a legging with an upper and lower region. The upper regions of the right and left panels are joined together at a seam, and the front and back regions of each legging panel are joined together at an "interior" seam. The patent does not disclose or claim seams that run vertically on the anterior and posterior sides of the leg portions of the wader.

U.S. Pat. No. 4,912,860 (Keller, 1990) covers a dual-height wader that has a body portion covering the lower body and a chest portion normally folded inside the body portion but extendable upward around the chest. U.S. Pat. No. 4,858,342 (Nicholson et al., 1989) discloses a method for making a thermoplastic-rubber wader with a rubber footwear bottom and a thermoplastic upper portion. Finally, U.S. Pat. No. 4,117,609 (Helt, 1978) and U.S. Pat. No. 4,044,478 (Girard, 1977) provide a rip cord safety device for waders and a quick release for waders, respectively.

In addition to the above patented inventions, at least one manufacturer has marketed a wader that has front and/or back seams, but the seams are radiofrequency-welded, not sewn and sealed, and the wader is not made of a breathable fabric (as in the present invention). The radiofrequency welding causes the seams to stick out approximately one-quarter of an inch (¼") from the surface of the wader, whereas the sewn-and-sealed seams of the present wader are flat. The radiofrequency-welded wader is not pre-curved as is the wader of the present invention and does not provide nearly the articulation in the knee and hip areas as the present invention does.

As is apparent from the foregoing discussion, no patent or published application to date has dealt with the problem of seam abrasion in waders or the discomfort caused by the traditional seam placement. It is an object of the present invention to provide a functional solution to the problem of seam abrasion in waders, particularly in the inseam area, and the problem of wearer discomfort caused by stiff seams. Seam abrasion can be particularly problematic with respect to waders due to the safety and comfort issues implicated when water enters the wader. The present invention solves these problems by changing the placement of the seams and by shaping the wader around the knee and hip regions to allow for ease of movement. By eliminating the inseams and outside seams altogether, the potential for fabric failure is drastically reduced. Not only is the wearer's comfort level increased, but the manufacturer's cost of repair is reduced.

BRIEF SUMMARY OF THE INVENTION

The present invention is a wader that is designed to address the problem of seam abrasion and to increase the wearer's comfort level by pre-curving the hip-waist portion and the leg portion to allow for ease of movement. The present invention solves the problem of seam abrasion by eliminating inseams and outside seams altogether and replacing them with front and back seams. The present invention claims a wader comprising a leg portion with a front and back seam and a wader comprising a leg portion and a hip-waist portion with front and back seams, wherein the wader is made of breathable fabric and the seams are sewn and sealed.

In addition to the unique seam placement, the present invention also provides that the hip-waist and leg portions of the wader are pre-curved to make it easier for the wearer to flex his or her leg, as in walking, running or sitting. The present invention can include, optionally, a chest portion in addition to the leg and hip-waist portions. It can also include a foot-covering component and a cinching device at the waist region. In the preferred embodiment, the seams are sewn and sealed with a thermoplastic adhesive tape. The present invention includes a method of manufacturing the wader described above.

REFERENCE NUMBERS

Figure 1:
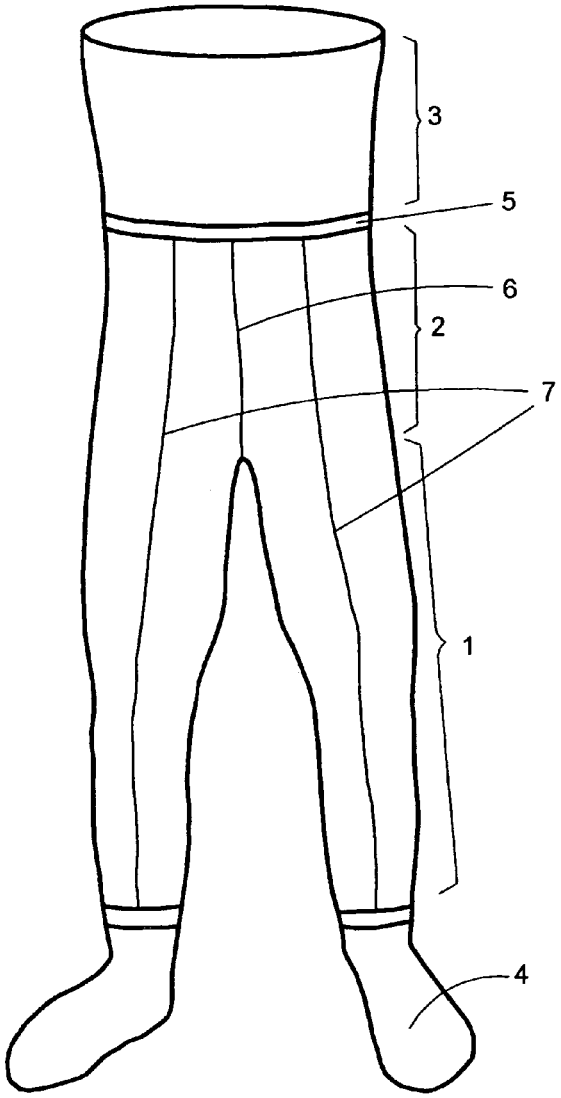
FIG. 1 is a front view of the wader of the present invention.

1 Leg portion
2 Hip-waist portion
3 Chest portion
4 Foot-covering component
5 Cinching device
6 Middle seam
7 Front seam
8 Back seam

DETAILED DESCRIPTION OF INVENTION

FIG. 1 is a front view of the wader of the present invention. In the preferred embodiment, the wader is made of a breathable fabric. The wader comprises a leg portion 1 and, optionally, a hip-waist portion 2 and a chest portion 3. The wader can include a foot-covering component 4, and it can also include a belt, drawstring or similar cinching device 5 at the waist region. The right and left leg portions are joined at a seam 6. Each leg portion has a front seam 7 that runs vertically down the anterior side of the leg portion. The front seam 7 is sewn and sealed with a thermoplastic adhesive tape or any other sealing means that performs the same or similar function.

Figure 2:
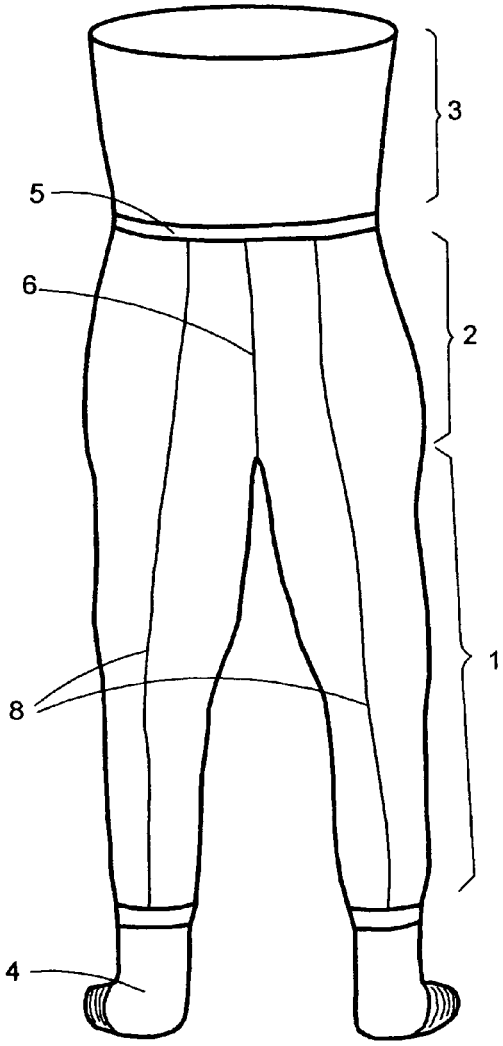
FIG. 2 is a back view of the wader of the present invention.

FIG. 2 is a back view of the wader of the present invention. The wader comprises a leg portion 1 and, optionally, a hip-waist portion 2 and a chest portion 3. The optional foot-covering component 4 is shown, as is the cinching device 5. The right and left leg portions are joined at a seam 6. Each leg portion has a back seam 8 that runs vertically down the posterior side of the leg portion. The back seam 8 is sewn and sealed with a thermoplastic adhesive tape or any other sealing means that performs the same or similar function.

Figure 3:
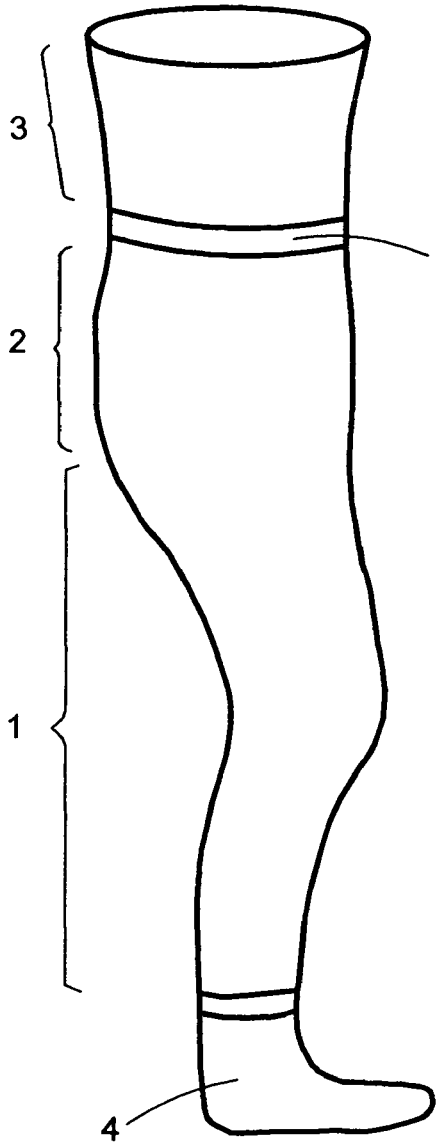
FIG. 3 is a view of the outside of the right leg of the wader of the present invention.

FIG. 3 is a view of the outside of the right leg of the wader of the present invention. The leg 1, hip-waist 2 and chest 3 portions are shown, as is the foot-covering component 4 and the cinching device 5. The hip-waist 2 and chest 3 portions, as well as the foot-covering component 4 and the cinching device 5 are all optional. As can be seen in this figure, the knee region of the leg portion 1 is pre-curved to follow the shape of the knee when it is flexed as in walking. The pre-curving in the knee is created by elongating the front seam through the knee and shortening the seam in the back of the knee. Similarly, the hip-waist portion 2 is also pre-curved to allow for greater flexibility when the wearer is walking, running or sitting. The pre-curving in the buttocks area is created by elongating the back seam in the buttocks area. In a typical wader, the leg 1 and hip-waist 2 portions would have an outside seam that runs vertically down the side of the wader. The outside seam is absent from the present invention.

Figure 4:
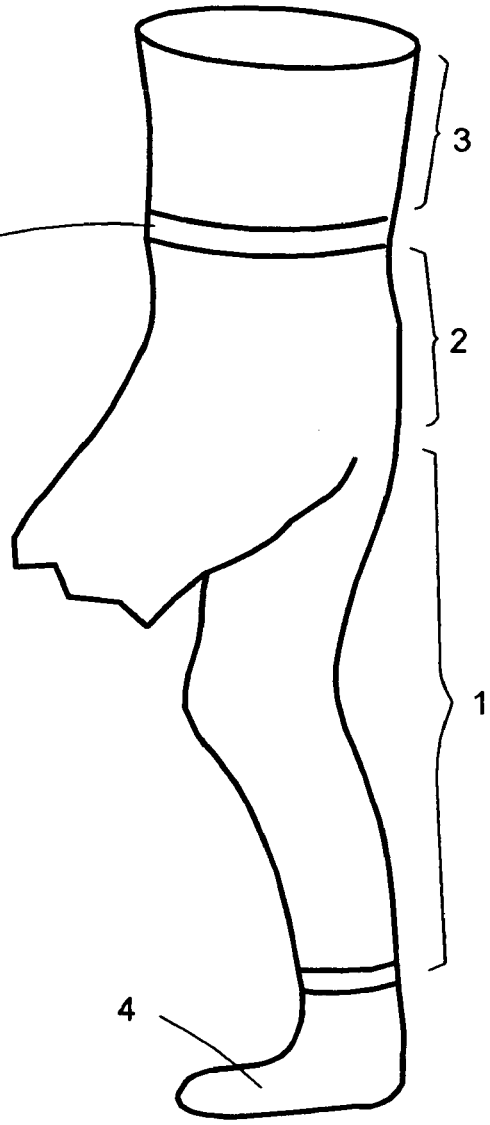
FIG. 4 is a view of the inside of the right leg of the wader of the present

FIG. 4 is a view of the inside of the right leg of the wader of the present invention. The leg 1, hip-waist 2, and chest 3 portions of the wader are shown, as are the foot-covering component 4 and the cinching device 5. As in FIG. 3, this figure illustrates the pre-curving in the knee region of the leg portion 1 of the wader, as well as in the hip-waist region 2. In a typical wader, the leg portion 1 would have an inseam that runs vertically from the crotch region to the ankle region. The inseam is absent from the present invention.

As a result of the pre-curving, the wader of the present invention performs better in the water because it has less drag and resistance. It is also safer and more comfortable for the wearer. The pre-curved knee facilitates the manufacturing process by providing articulation at the knee without adding darts, which are a time-consuming and difficult part of the wader to produce while eliminating leaks. The seam placement, combined with a breathable fabric, greatly increases the comfort of the wearer and reduces seam abrasion.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A wader comprising a leg portion with a front seam and a back seam, wherein the wader is made of a breathable fabric, and wherein the leg portion is pre-curved to fit the shape of a flexed knee by elongating the front seam through the knee and shortening the seam in the back of the knee.

2. A method of manufacturing a wader of breathable fabric having a leg portion with a front seam and a back seam, comprising the steps of:

(a) pre-curving the leg portion to fit the shape of a flexed knee;

(b) providing a front seam that runs vertically down the anterior side of the leg portion;

(c) providing a back seam that runs vertically down the posterior side of the leg portion; and (d) sealing the seam with a sealing means.

3. The method of claim 2, wherein the sealing means is a thermoplastic adhesive tape.

4. A method of manufacturing the wader of claim 1, comprising the steps of:

(a) pre-curving the leg portion to fit the shape of a flexed knee;

(b) pre-curving the hip-waist portion to allow for greater flexibility when the wearer is walking, running or sitting;

(c) providing a front seam that runs vertically down the anterior side of the leg and hip-waist portions;

(d) providing a back seam that runs vertically down the posterior side of the leg and hip-waist portions; and (e) sealing the seam with scaling means.

5. The method of claim 4, wherein the sealing means is a thermoplastic adhesive tape.

6. The method of claim 2 or 4, wherein the leg portion is pre-curved by elongating the front seam through the knee and shortening the seam in the back of the knee.

7. The method of claim 4, wherein the hip-waist portion is pre-curved by elongating the back seam in the buttocks area.

8. A wader comprising a leg portion and a hip-waist portion with front and back seams, wherein the wader is made of a breathable fabric, and wherein the leg portion is pre-curved to fit the shape of a flexed knee by elongating the front seam through the knee and shortening the seam in the back of the knee.

* * * * *